US011407566B2

(12) United States Patent
Szap et al.

(10) Patent No.: US 11,407,566 B2
(45) Date of Patent: Aug. 9, 2022

(54) HANDHELD CONTAINER COVER ASSEMBLY

(71) Applicant: Zippy Planet, LLC, Port Washington, NY (US)

(72) Inventors: Allison Szap, Port Washington, NY (US); Bryan Vanderputten, Port Washington, NY (US)

(73) Assignee: ZIPPYPLANET, LLC, Port Washington, NY (US)

( * ) Notice: Subject to any disclaimer, the term of this patent is extended or adjusted under 35 U.S.C. 154(b) by 0 days.

(21) Appl. No.: 17/611,473

(22) PCT Filed: Feb. 16, 2021

(86) PCT No.: PCT/US2021/018260

§ 371 (c)(1),
(2) Date: Nov. 15, 2021

(87) PCT Pub. No.: WO2021/163704

PCT Pub. Date: Aug. 19, 2021

(65) Prior Publication Data

US 2022/0144501 A1 May 12, 2022

Related U.S. Application Data

(60) Provisional application No. 62/976,326, filed on Feb. 13, 2020.

(51) Int. Cl.

| | |
|---|---|
| ***B65D 43/02*** | (2006.01) |
| ***B65D 51/18*** | (2006.01) |
| ***A47G 21/18*** | (2006.01) |

(52) U.S. Cl.
CPC ..... *B65D 43/02* (2013.01); *A47G 21/18* (2013.01); *B65D 51/18* (2013.01)

(58) Field of Classification Search
CPC ..... A47G 19/22; A47G 19/2222; A47G 19/2266; A47G 19/2272; A47G 21/18;
(Continued)

(56) References Cited

U.S. PATENT DOCUMENTS

| | | | |
|---|---|---|---|
| 5,150,815 | A | 9/1992 | Saklad |
| 5,339,982 | A | 8/1994 | Tardie |

(Continued)

*Primary Examiner* — Don M Anderson
*Assistant Examiner* — Madison L Poos
(74) *Attorney, Agent, or Firm* — Mark C. Johnson; Johnson Dalal

(57) ABSTRACT

A container cover assembly with a stopper member having an outer sidewall of an elastically deformable material and a flange member extending radially outward from the outer sidewall, an inner cap member with the upper surface having the flange member of the stopper member seated thereon, the inner cap member operably configured to selectively and removably couple with a complementary threaded configuration on a conventional liquid container, wherein the stopper member is configured to seal with the upper end of the container. A collar member is coupled to the inner cap member and designed to retain a flexible straw member, wherein a protective cap member is configured to rotate with respect to the collar member to cover and retain the flexible straw member.

17 Claims, 16 Drawing Sheets

(58) Field of Classification Search
CPC .... A47G 21/184; A47G 22/186; B65D 43/02; B65D 43/08; B65D 47/00; B65D 47/04; B65D 51/18
USPC ..... 220/780
See application file for complete search history.

(56) References Cited

U.S. PATENT DOCUMENTS

| | | | | |
|---|---|---|---|---|
| 5,579,948 | A | 12/1996 | Lin | |
| 10,123,641 | B1 * | 11/2018 | Pepper | A47G 21/189 |
| 2011/0062170 | A1 | 3/2011 | Kemper et al. | |
| 2013/0277329 | A1 | 10/2013 | Defelice et al. | |
| 2017/0340148 | A1 * | 11/2017 | Chen | A47G 21/18 |
| 2019/0075950 | A1 * | 3/2019 | Xu | A47G 19/2288 |
| 2020/0095025 | A1 * | 3/2020 | Thorez | B65D 47/00 |
| 2020/0237624 | A1 * | 7/2020 | Campbell | A61J 9/0669 |

* cited by examiner

910

906

908

HANDHELD CONTAINER COVER ASSEMBLY

FIELD OF THE INVENTION

The present invention relates generally to handheld container cover assembly and, more particularly, relates to a cap or cover with a straw configured to couple with a handheld container.

BACKGROUND OF THE INVENTION

Many users utilize handheld containers for consuming liquid drinks, including soda, water, energy drinks, etc. These handheld containers generally include an upper end or nozzle where the liquid flows through. Many users, however, desire to drink the contents of the handheld container with a straw. Many users also desire to utilize their own drinking cover or cap to a variety of different handheld containers, regardless of the sealing or coupling configuration disposed at the upper end or nozzle of the handheld container.

Some known covers or caps designed to attach to the top of different handheld liquid containers fail to effectively and efficiently couple with the upper ends of said containers. More specifically, many of those known covers or caps configured to utilize a straw are prone to spilling or leakage when in use, particularly over long periods of use or due to improper attachment by a user.

Those known covers or caps also fail to effectively utilize a straw for different types of liquids housed in the container. For example, some users desire a slow liquid flow when utilizing a straw and some users desire a faster liquid flow. Some contained liquids, e.g., carbonated, gas-infused, or aerated liquids, also require or desire different flow speeds or connections with the container.

Additionally, those known covers or caps do not effectively or efficiently prevent contamination when the cover or cap is not in use. More specifically, when the cover or cap is not utilized (e.g., when traveling), the upper and lower portion of a straw are kept open or are otherwise not covered.

Therefore, a need exists to overcome the problems with the prior art as discussed above.

SUMMARY OF THE INVENTION

The invention provides a handheld container cover assembly that overcomes the hereinafore-mentioned disadvantages of the heretofore-known devices and methods of this general type and that is reusable and includes an incorporated or built-in straw that is operably configured to be extended and folded for effective use and storage. The handheld container cover assembly is also configured to couple with the upper end of most handheld containers that have a threaded or non-threaded configuration disposed proximal thereto with minimal or no spillage. Embodiments of the invention also include a sealing stopper to effectively prevent spillage from the cover when coupled to the container. The straw is also configured to have an airtight fit or not an airtight fit to provide for faster liquid flow. The handheld container cover assembly also beneficially includes a top shield and a carrying case to protect the straw from contamination when not in use.

With the foregoing and other objects in view, there is provided, in accordance with the invention, a handheld container cover assembly that includes a stopper member having an outer sidewall, a lower end defining an enclosed straw channel, an upper end opposing a lower end, a flange member extending radially outward from the outer sidewall of the stopper member, the outer sidewall of an elastically deformable material. The assembly also includes an inner cap member with an upper surface having the flange member of the stopper member seated thereon, a lower surface opposing the upper surface of the inner cap member, and a sidewall with an inner surface having a threaded configuration operably configured to selectively and removably couple with a complementary threaded configuration disposed on an outer surface of the sidewall of the liquid container defining an enclosed upper aperture thereon, wherein the inner surface of the sidewall and the outer sidewall define a double-walled enclosed container channel shaped and sized to receive the sidewall of the liquid container. The assembly also includes a collar member with a lower end, an upper end opposing the lower end, a sidewall, and defining an enclosed straw aperture on the upper end of the collar member, the collar member selectively removably coupled in a longitudinally locked configuration with the inner cap member. Further, the assembly includes a protective cap member with an upper wall and a sidewall, wherein the sidewall of the protective cap member surrounds the upper wall of the protective cap member, defines a straw cap aperture thereon, and is rotatably coupled to the collar member. The assembly may additionally include a flexible straw member with a lower end, an upper distal end opposing the lower end of the flexible straw member, a straw conduit separating the lower end of the flexible straw member and the upper distal end of the flexible straw member, and operably configured to project through the straw cap aperture and have the upper distal end disposed above the upper wall of the protective cap member, wherein the protective cap member operably configured to rotate with respect to the upper end of the collar member to house and cover (partially or, preferably, fully) the flexible straw member with the upper wall of the protective cap member.

Although the invention is illustrated and described herein as embodied in a handheld container cover assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the container cover assembly, spanning from a lower end of the cover to the upper end of the cover, or from a lower end of the stopper member to the upper wall of the protective cap member.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
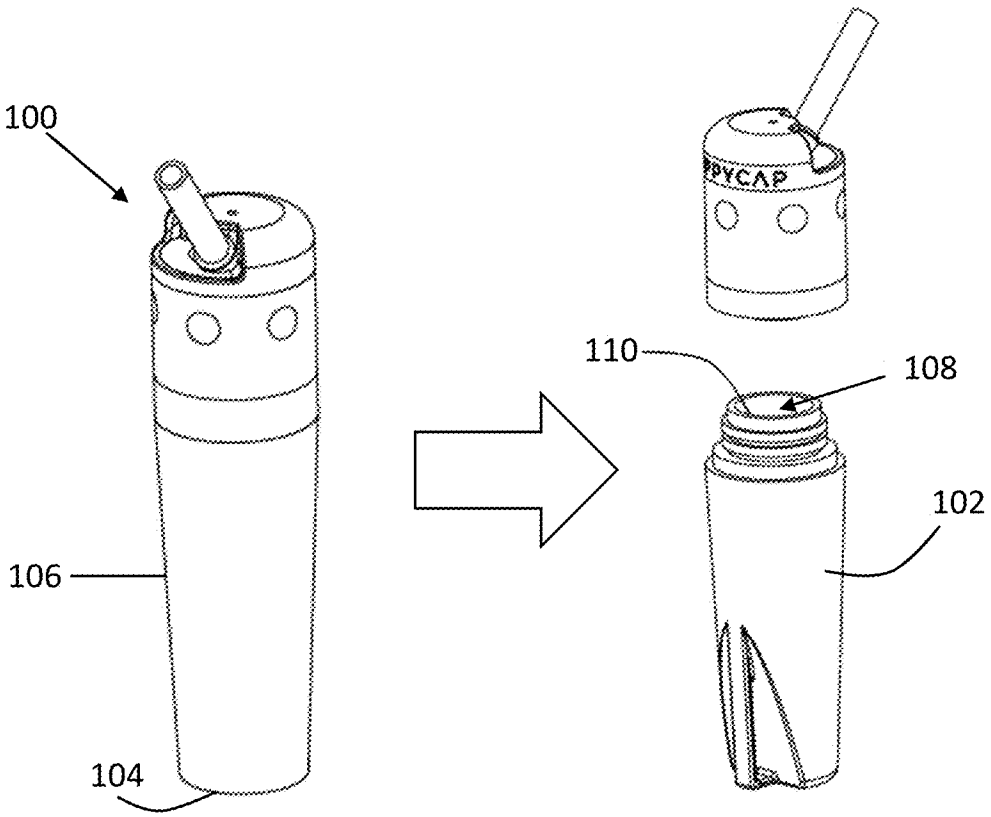
FIG. 1 is a perspective view of a container cover assembly coupled and uncoupled to a storage container body in accordance with one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient handheld container cover assembly. Embodiments of the invention provide a container cover assembly that overcomes known disadvantages of those known devices and methods of this general type and that provides for fast and easy attachment of a reusable straw to standard-sized water or beverage bottles or to the storage container body provided therein with a watertight seal that prevents leakage. The container cover assembly is generally made of durable material allowing it to be reused multiple times and the straw-bearing components of the container cover assembly may be attached onto standard-sized water or beverage bottles for use thereon. Although the invention is illustrated and described herein as embodied in a container cover assembly, it is, nevertheless, not intended to be limited to the details shown because various modifications and structural changes may be made therein without departing from the spirit of the invention. Additionally, well-known elements of exemplary embodiments of the invention will not be described in detail or will be omitted so as not to obscure the relevant details of the invention.

Referring now to FIG. 1, one embodiment of the present invention is shown in a perspective view diagram. FIG. 1 shows several advantageous features of the present invention, but as will be described below, the invention can be provided in several shapes, sizes, combinations of features and components, and varying numbers and functions of the components. The first example of a container cover assembly 100, as shown in FIG. 1, includes a storage container body 102 with a bottom wall 104 and a sidewall 106 enclosing the bottom wall 104 and defining an enclosed upper aperture 108.

In a preferred embodiment of the present invention, the storage container body 102 is of a substantially rigid material, such as acrylonitrile-butadiene-styrene, polypropylene, or stainless steel, facilitating secure and hygienic storage of a stopper member 200 and a straw 202. In other embodiments, the storage container body 102 may be of a different form of thermoplastic wherein the storage container body 102 is not easily deformable and retains its original shape when handled or manipulated by a user. All components are preferably food grade in that they are deemed safe for contact with liquids intended for human consumption, though the storage container body 102 is not intended or designed for the storage of liquid contents. Rather, the storage container body 102 is intended to serve as an aid for the storage of the stopper member 200 when the stopper member 200 is not in use. The stopper member 200 may be pushed down onto the enclosed upper aperture 108 of the storage container body 102 when not in use to ensure that no germs or bacteria accumulate on or around the enclosed upper aperture 108.

In conjunction with the present invention, the bottom wall 104 is of a substantially circular shape and is designed to enable the storage container body 102 and container cover assembly 100 to stand upright on any flat surface. The sidewall 106 encloses and defines the bottom wall 104. An inner surface 110 of the sidewall 106 defines the cylindrical storage container body 102 that extends upward and defines the enclosed upper aperture 108. Other shapes of the storage container body 102, however, are contemplated. The enclosed upper aperture 108 may, in one embodiment, be substantially circular in shape.

Figure 3:
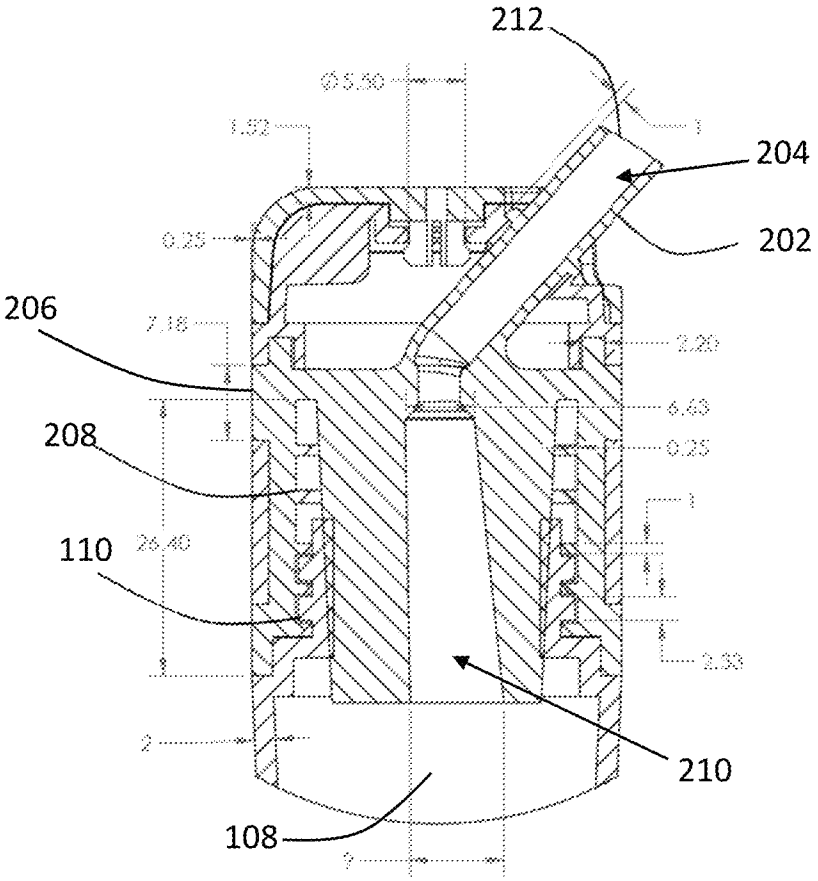
FIG. 3 is a cross-sectional view of an inner cap member, stopper member, flexible straw, collar member, and protective cap member in accordance with one embodiment of the present invention.
Figure 2:
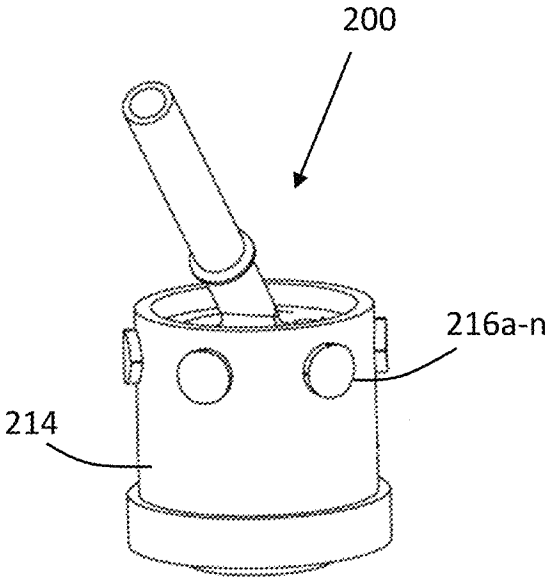
FIG. 2 is a perspective view of an inner cap member, stopper member and flexible straw in accordance with one embodiment of the present invention.

Referring now to FIG. 2 and FIG. 3, the stopper member 200 comprises the straw 202 defining a straw channel 204, a sealing member 206 disposed within the enclosed upper aperture 108, and an outer sidewall 208, whereby the sealing member 206 and the outer sidewall 208 are configured to create a watertight perimeter seal that prevents leakage or spillage.

In a preferred embodiment, the stopper member 200 is made with an elastically deformable material, such as food grade polymerized siloxane, generally referred to as silicone, or rubber which may be manipulated to a certain degree to fit onto the enclosed upper aperture 108. The straw 202, like the stopper member 200, may also be of a food grade polymerized siloxane, generally referred to as silicone, rubber, or another substantially flexible material capable of bending.

The straw channel 204 may vary in width in various embodiments but must be wide enough to facilitate the fluid movement of liquid contents through the straw channel 204.

Figure 7:
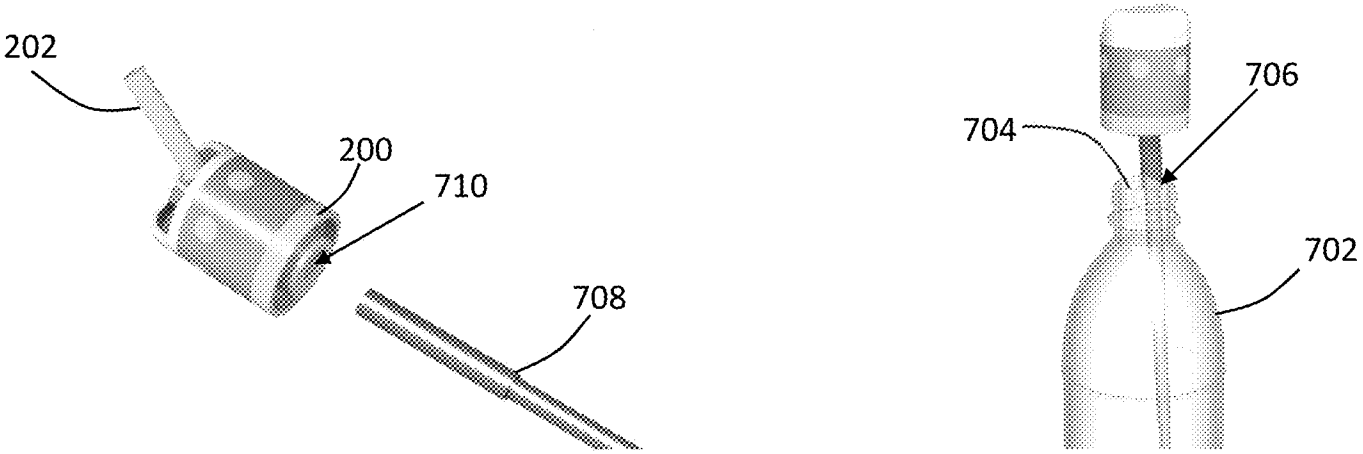
FIG. 7 depicts perspective views of a container cover assembly with a portion of a flexible straw member uncoupled thereto and the assembly, with the flexible straw member, partially inserted into a liquid container body configured to house and retain a liquid in accordance with one embodiment of the present invention.

The sealing member 206 defines a liquid transport channel 210 therein fluidly coupled to the straw channel 204, wherein the liquid transport channel 210 and the straw channel 204 facilitate the fluid movement of liquid contents from the upper end 212 of the straw 202 to a container body 702. FIG. 7 provides one embodiment of the present invention, in which the container body 702 is intended to be an independent liquid container, such as a standard-sized bottle or aluminum can, housing liquid contents for human consumption. In a preferred method of use, a user would purchase or obtain a standard-sized beverage bottle from any retailer or third party, remove the storage container body 102 from the rest of the container cover assembly 100, and affix the remaining portions of the container cover assembly 200 (comprised of the stopper member 200, a collar member 400, and a protective cap member 500) onto the container body 702 by applying force to push said parts down onto the container body 702. As such, the container cover assembly 200 may be retained onto the top of the container body 702 via compression and/or frictional resistance caused by the stopper member 200 and/or the collar member 400 and the container body 702.

As those of skill in the art will appreciate, the liquid housed by the container body 702 may be removed therefrom by either a vacuum/suction force or gravity. In a preferred embodiment, the sealing member 206 is of an impermeable elastically deformably material, e.g., silicone, that prevents the leakage or spillage of any liquid contents from the container cover assembly 100. Similarly, the stopper member 200 may also be of an impermeable elastically deformable material.

The outer sidewall 208 of the stopper member 200 and an inner surface 704 of the container body 702 define a watertight perimeter enclosing part of the sealing member 206 and the liquid transport channel 210 therein. The elastically deformable material of the sealing member 206 is designed to contour and closely fit the threaded configuration defining an upper aperture 706 of the container body 702, which design is intended to provide effective watertight protection against spills and leaks. This elastically deformable quality of the sealing member 206 enables the stopper member 200 to fit various-sized upper apertures 706 of different container bodies 702 within a standard range in the industry.

An outer surface 214 of the stopper member is defined by a plurality of protruding locking members 216*a-n*, wherein "n" represents any number greater than two. In a preferred embodiment, the plurality of locking members 216*a-n* are comprised of a food grade polymerized siloxane, generally referred to as silicone, or rubber, which may be manipulated to a certain degree to fit into and through a plurality of apertures 402*a-n*, wherein "n" represents any number greater than two, disposed along a sidewall 408 of the collar member 400.

Figure 4:
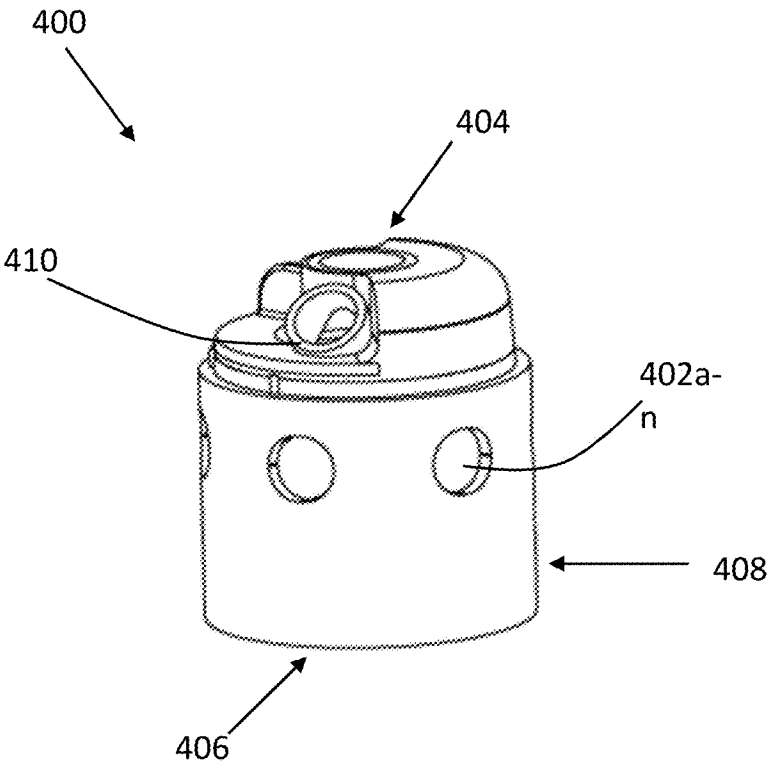
FIG. 4 is a perspective view of a collar member and protective cap member in accordance with one embodiment of the present invention.

As best seen in FIG. 4, the plurality of apertures 402*a-n* are proportionately sized and shaped in relation to the plurality of locking members 216*a-n*, ensuring that the plurality of locking members 216*a-n* may snugly fit into and through the plurality of apertures 402*a-n*, thereby locking the collar member 400 and stopper member 200 into place. The collar member 400 is of a substantially rigid material, such as acrylonitrile-butadiene-styrene or polypropylene, ensuring that the tight fit between the collar member 400 and the stopper member 200 prevents the leakage or spillage of the liquid contents when fluidly moving into and out of the enclosed upper aperture 108.

The collar member 400 comprises an upper wall 404, a lower wall 406, and the sidewall 408 defining the upper wall 404. The collar member 400 defines a straw aperture 410 on the upper end of the collar member 400 with the straw 202 of the stopper member 200 protruding therethrough.

Figure 5:
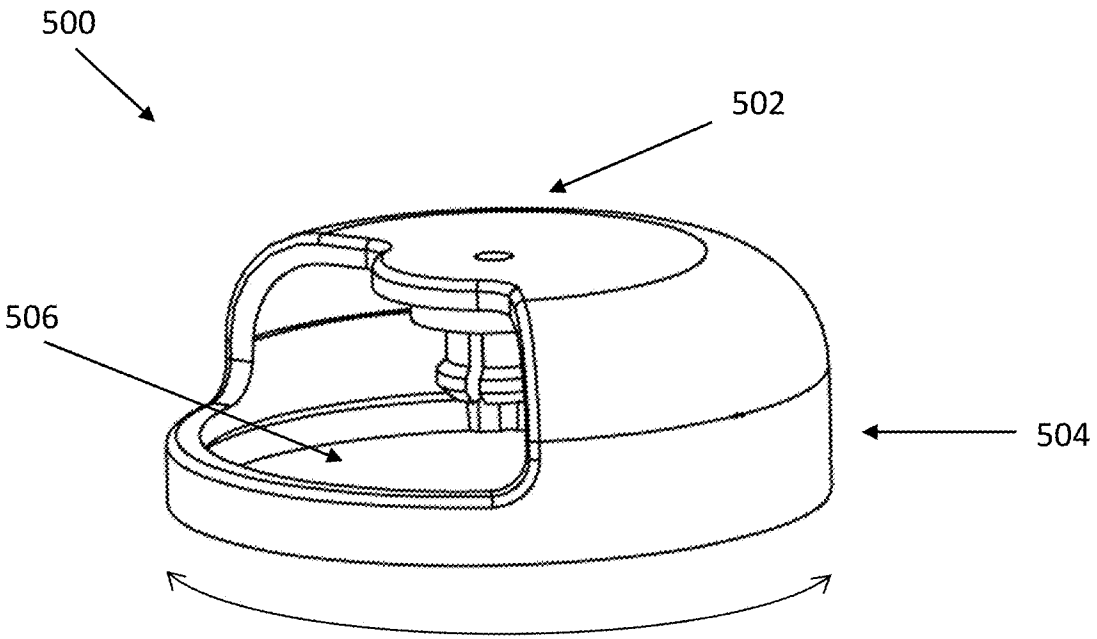
FIG. 5 is a perspective view of a protective cap member in accordance with one embodiment of the present invention.

Referring now to FIG. 5, the present invention further comprises the protective cap member 500 comprising an upper wall 502 and a sidewall 504, the sidewall 504 of the protective cap member 500 surrounding the upper wall 502 and defining a straw aperture 506 thereon.

The protective cap member 500 is rotatably coupled to the collar member 400 and is operably configured to rotate with respect to the upper end 404 of the collar member 400 to cover and protect the straw 202 with the upper wall 502 of the protective cap member 500. This design feature allows users to twist the protective cap member 500 to obtain access to the straw 202 when they desire to use it, and twist it back into its original position to hide and store the straw 202 beneath the upper wall 502 of the protective cap member 500. Some measure of force or pressure must be applied by the user to twist and rotate the protective cap member 500 to reveal or enclose the straw 202.

Figure 6:
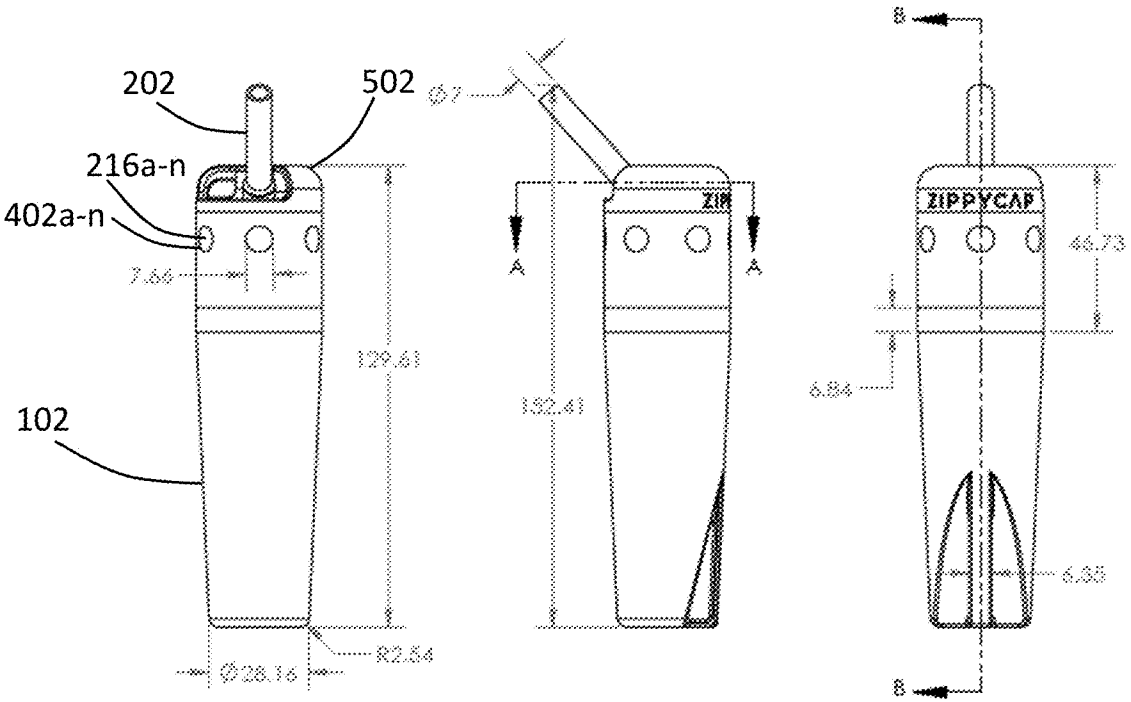
FIG. 6 depicts elevational side views of a container cover assembly coupled to a storage container body in accordance with one embodiment of the present invention.

FIG. 6 provides several cross-sectional views of the container cover assembly 100 when packaged and not yet in use. FIG. 6 depicts the storage container body 102, the plurality of apertures 402*a-n*, the plurality of locking members 216*a-n*, the straw 202, and the upper wall 502 of the protective cap member 500. In one embodiment, the protective cap member 500, the stopper member 200, and the collar member 400 are substantially of a rigid polymeric material, e.g., food grade ABS plastic or polypropylene. Some exemplary dimensions (in millimeters) are also depicted in the figures but may be varied based on the design application and constraints.

FIG. 7 depicts the container cover assembly 100 when fully assembled and in use. The stopper member 200, the collar member 400, the protective cap member 500, and a straw member 708 are all affixed, through the user's use of force to push said components downward onto the upper aperture 706, to the upper aperture 706 of the container body 702. The straw member 708 may be of a stainless steel or other substantially rigid composition or material capable of withstanding the wear and tear associated with multiple reuses of the same straw member 708. One end of the straw member 708 is configured to be inserted into a straw opening 710 of the stopper member 200, wherein the straw member 708 may retained by the stopper member 200 via compression and/or resistance caused by the elastically deformable material of the stopper member 200.

In a preferred embodiment, and as best seen in FIG. 7, the straw member 708 has a telescopic design in that the straw member 708 is capable of selectively extending and retracting to fit within various sized container bodies 702. Other embodiments may feature a straw member 708 that is shorter in size to accommodate a proper fit within beverage bottles of shorter height or smaller size. Still other embodiments may feature a flexible or selectively extendable straw member 708 capable of bending or folding.

When the container cover assembly 100 is utilized in conjunction with a conventional drinking can, the sizing of the stopper member 200 and the coupling method may be varied, e.g., the outer diameter of the sealing member 206 may be smaller and the lower end of the stopper member 200 may be directly coupled to the can using compression and/or a flange configuration.

Figure 8:
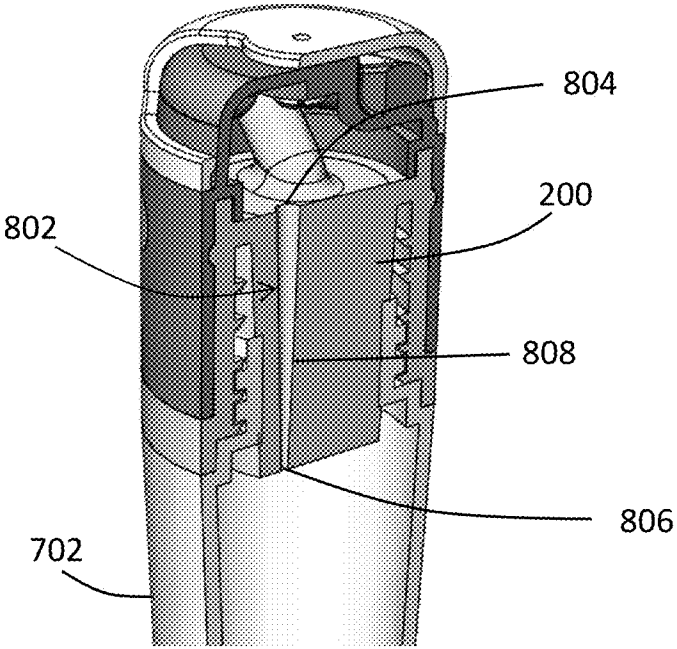
FIG. 8 depicts a cross-sectional view of a container cover assembly coupled to a storage container body and the flexible straw member housed and retained by the protective cap member in accordance with one embodiment of the present invention.
Figure 9:
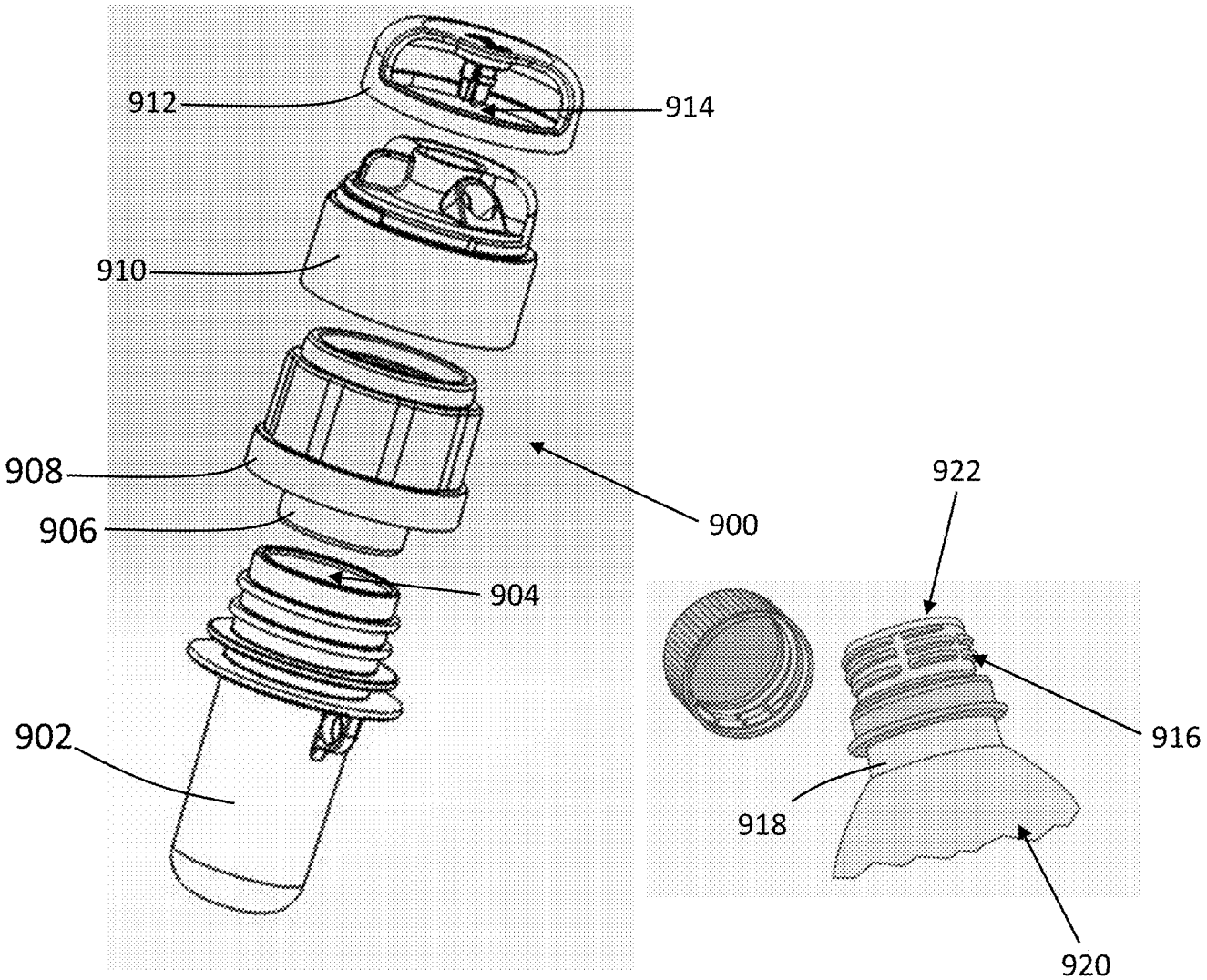
FIG. 9 depicts an exploded view of a container cover assembly and a fragmentary view of a container body in accordance with one embodiment of the present invention.

As depicted in FIG. 8, the stopper member 200 may further comprise a ventilation aperture 802 designed to maintain proper ventilation flow and air control within the container body 702. The ventilation aperture 802 comprises an upper end 804 and a lower end s defining a ventilation channel 808. When the container cover assembly 100 is in use, a user places their lips around the upper end 212 of the straw 202 and sucks in air in order to stimulate the flow of the liquid contents housed in the container body 702 through the straw member 708, the straw channel 204, and into the user's mouth. When air is sucked out of the container body 702 in this manner, it causes the container body 702, especially where it is of a plastic or aluminum composition, to constrict and deform inward. The ventilation aperture 802 counters this effect by allowing air to flow into the container body 702 when air is sucked out through the straw 202 by a user. In this way, the ventilation aperture 802 preserves and maintains the physical integrity of the container body 702.

In a preferred embodiment of the present invention, the ventilation channel 808 is tapered in size and progressively widens in diameter with respect to the upper aperture 804. This design feature may vary in different embodiments and is intended to allow air to flow freely, but to prevent or restrict the liquid contents within the container body 702 from doing the same. The ventilation channel 808 enables the internal cavity of the container body 702 to remain or be placed in a relatively close internal pressure substantially equivalent to the atmospheric pressure.

In another embodiment of the present invention, as depicted in FIGS. 9-17, a container cover assembly 900 is also depicted. In this embodiment, a storage container body 902 may be utilized and includes a bottom wall and a sidewall enclosing the bottom wall and defining a storage cavity for housing a straw 1000 therein when not utilized and defining an enclosed upper aperture 904. The storage container body 902 may include a key ring loop to enable convenient carrying by the user when not desire for use. The cover assembly 900 is operably configured (as discussed herein) to selectively removably couple to liquid storage container (as exemplified in FIG. 7 with numeral 702), such as a conventional soda or water bottle, while in other embodiments the liquid storage container may be specially adapted or designed to work with the container cover assembly 900.

Figure 10:
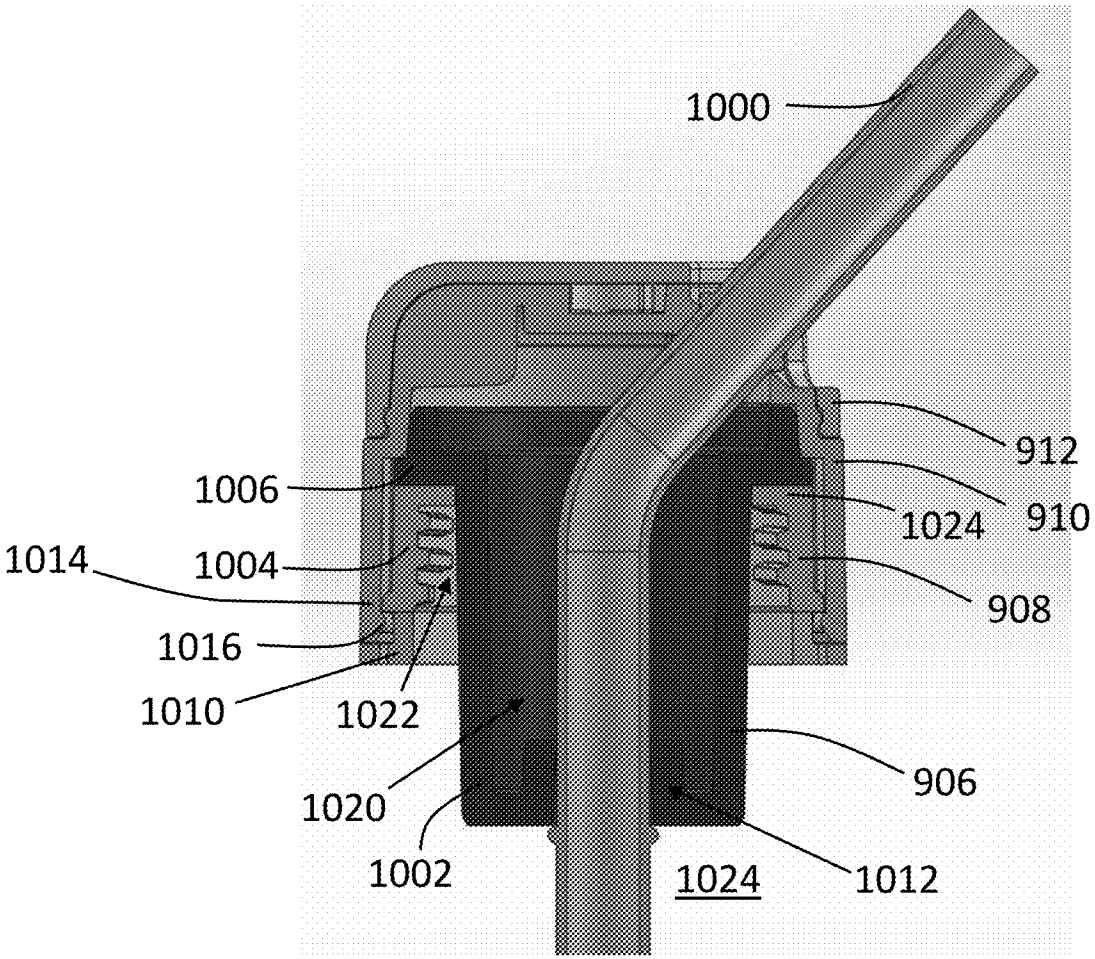
FIG. 10 is a cross-sectional and fragmentary view of an inner cap member, stopper member, flexible straw, collar member, and protective cap member in accordance with one embodiment of the present invention.
Figure 11:
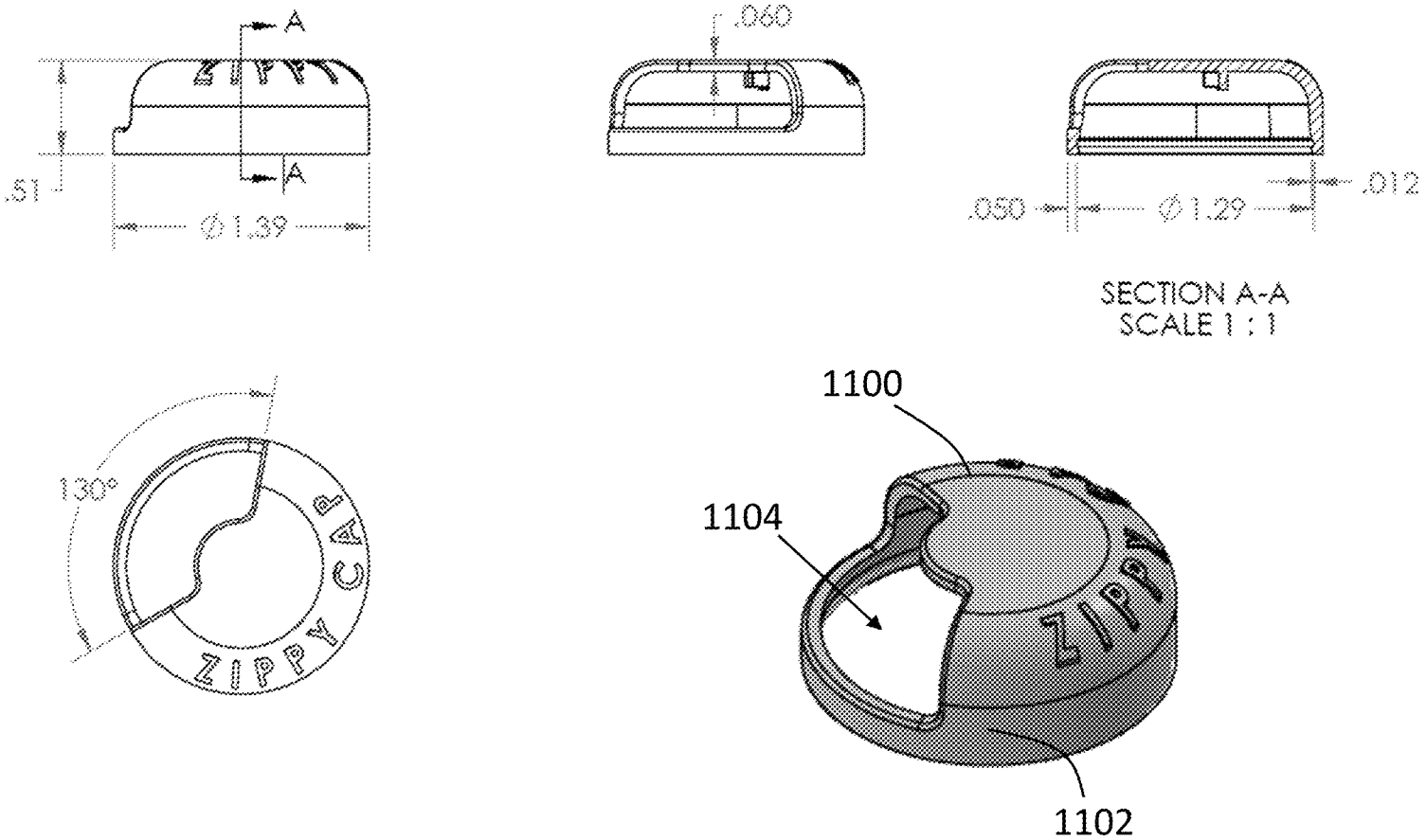
FIG. 11 depicts various views of a protective cap member in accordance with one embodiment of the present invention.
Figure 14:
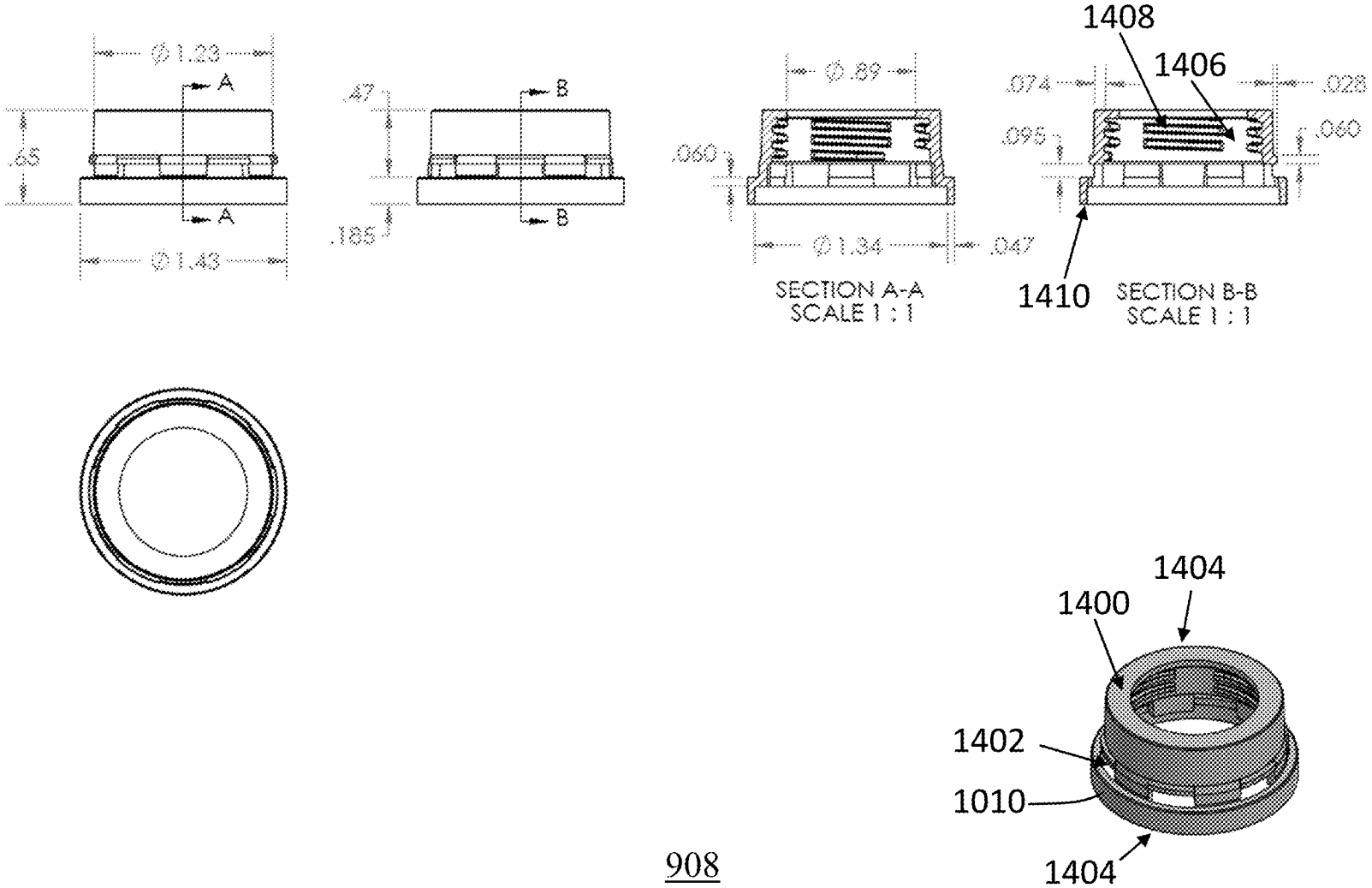
FIG. 14 depicts various views of an inner cap member in accordance with one embodiment of the present invention.
Figure 15:
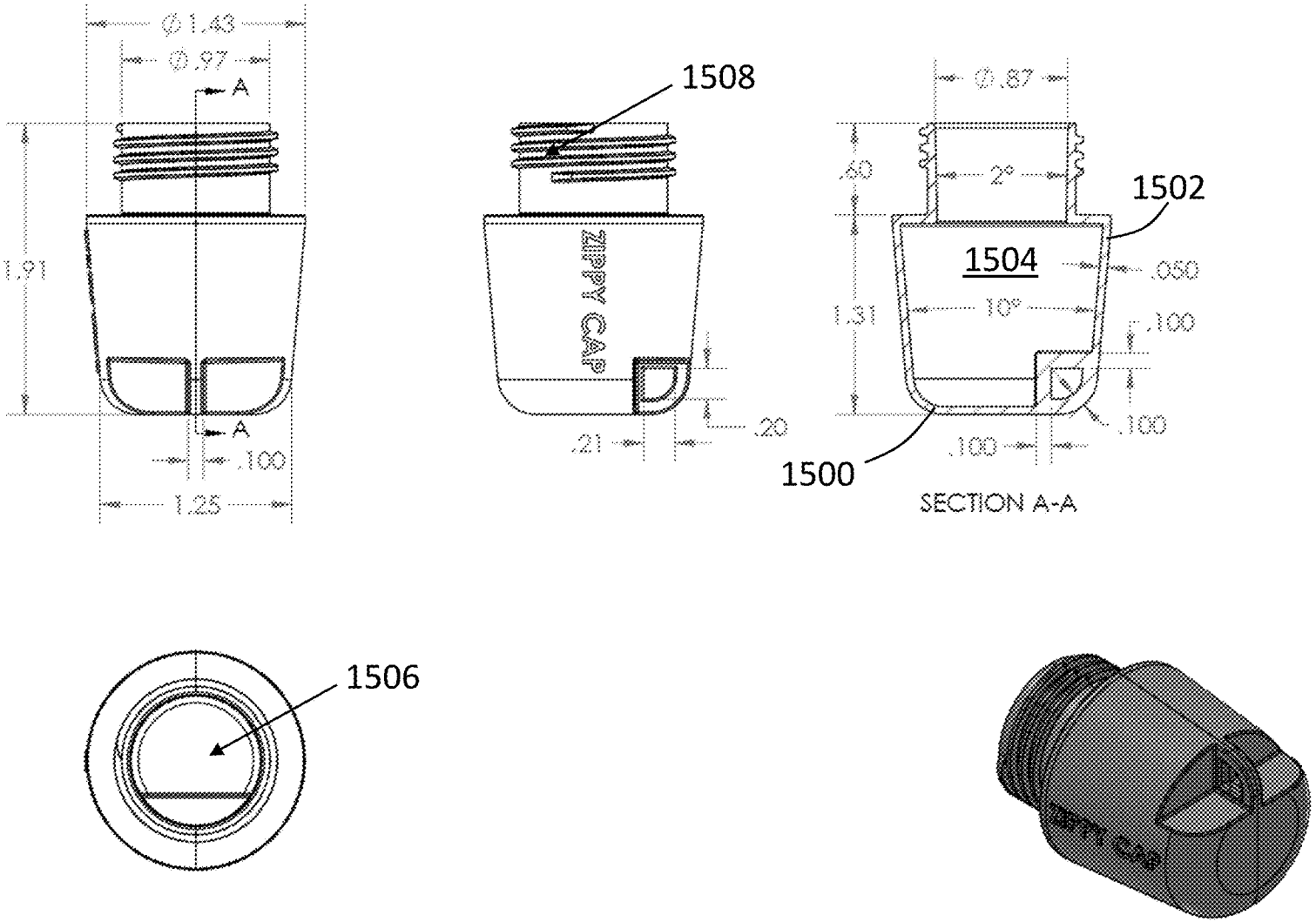
FIG. 15 depicts various views of a storage container body in accordance with one embodiment of the present invention.

Similar to the above-described assembly, a stopper member 906 may be utilized to create a watertight and preferably circumferential seal with the portion (i.e., inner surface) of the container body 902 defining the enclosed upper aperture 904. In one embodiment, the stopper member 906 may include a sidewall 1002 with a portion that is tapered in diameter (best seen in FIG. 10) as it spans from a bottom surface 1302 of a flange located on the stopper member 906 to a distal lower end 1304 of the stopper member 906. In one embodiment, the stopper member 906 is of a deformable material, a flexible material, and/or an elastic material, such as a natural rubber or neoprene. In other embodiments, the stopper member 906 may be more rigid and may include a rubber gasket or seal utilized to prevent liquid housed in the container cavity from exiting therefrom. As best seen in FIG. 10 and FIG. 14, the stopper member 906 may include a flange 1006 that seats on top of an upper surface 1400 of an inner cap member 908. The flange member 1006 may be interposed or sandwiched between the inner cap member 908 and the collar member 910 (with the protective cap member 912 disposed above the collar member 910), thereby prevented from moving longitudinally when the inner cap member 908 is rotatably fastened or screwed onto the container body 902 or the liquid container 702.

Figure 16:
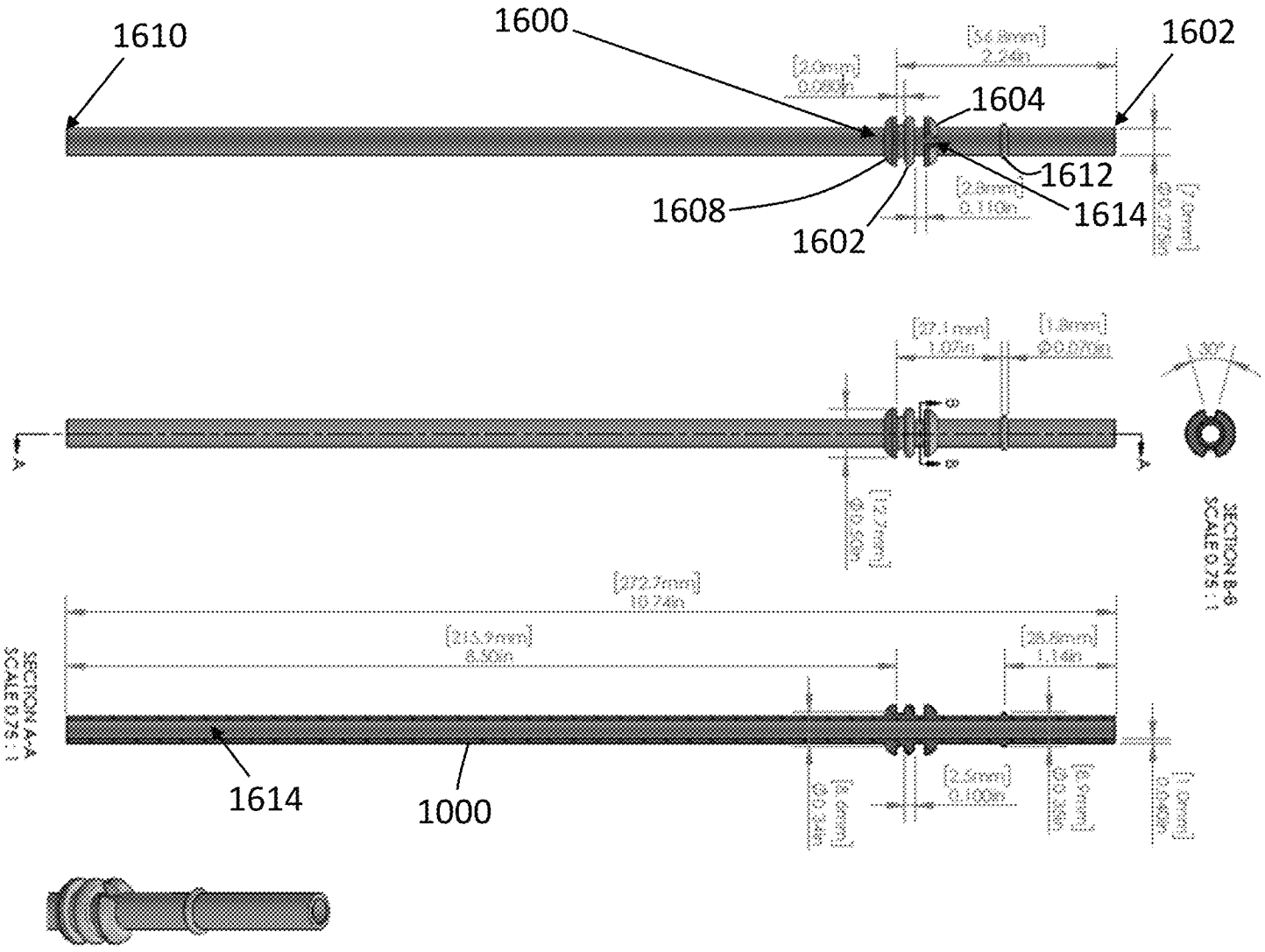
FIG. 16 depicts various views of a flexible straw member in accordance with one embodiment of the present invention.
Figure 17:
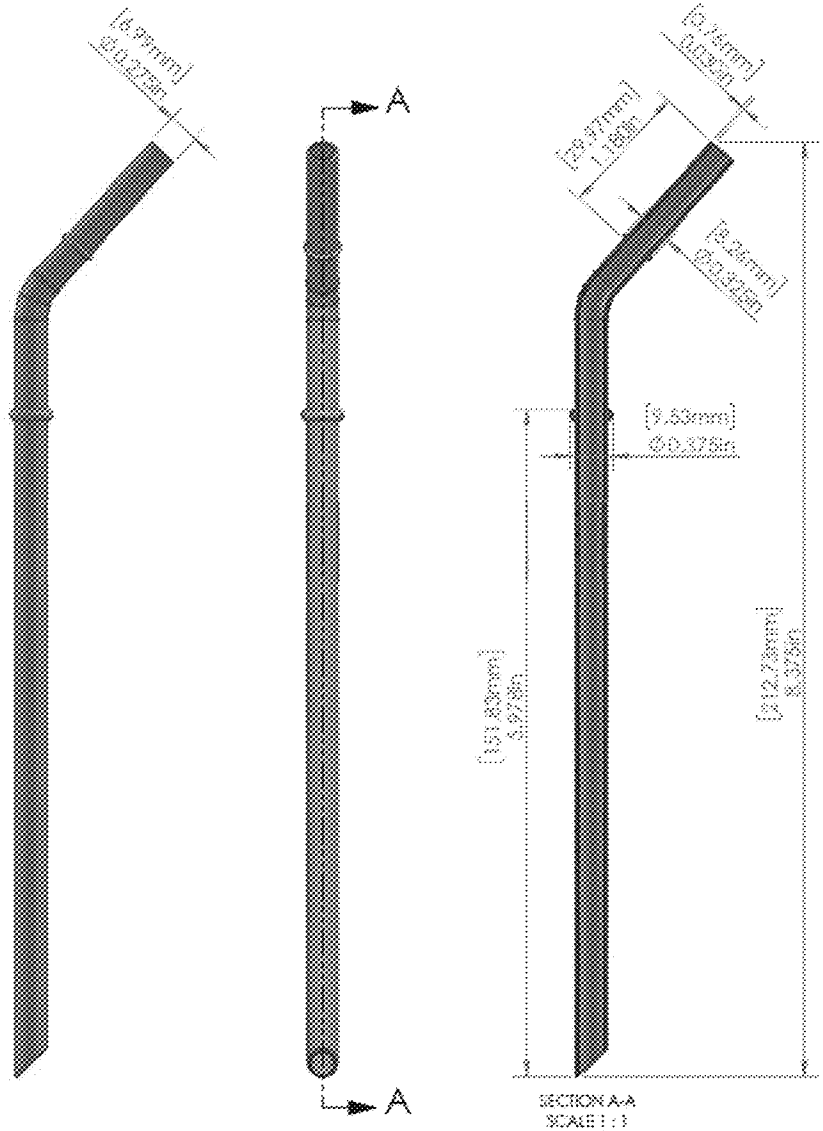
FIG. 17 depicts various views of another flexible straw member in accordance with one embodiment of the present invention.

Still looking at FIG. 10 (with reference to FIG. 7 and FIG. 13) a straw 1000 (of the same material discussed above) is disposed within a straw channel 1300 (shown best in FIG. 13) defined thereon. The outer sidewall 1002 is disposed within the enclosed upper aperture 904 or the aperture 706 defined by the inner surface 704 of the liquid container 702 and in a watertight perimeter sealing configuration. Said another way, the surface of the outer sidewall 1002 may contact (preferably circumferentially) the inner surface of the sidewall of the storage container body 902 or the liquid container 702 defining the enclosed upper apertures 904, 706, respectively. The straw 1000 is disposed within a cavity of the liquid container or (when not desired for use) a storage cavity defined by the storage container body 902 and includes a lower end disposed proximal to a bottom wall of the liquid container 702, thereby enabling access of the liquid housed in the container body. The straw 1000 may beneficially fold and/or deform while stored inside of the storage container body 902 and may be encapsulated therein to reduce and/or prevent contamination while not desired for use). As depicted best in FIGS. 16-17, the straw 1000 may include a flange located thereon that prevents longitudinal movement of the straw as desired, e.g., passed the lower end 1304 of the stopper member 906. The straw 1000 may also include unique configurations and dimensions as depicted in FIGS. 16-17, e.g., of a length that prevents the straw from completely falling into the container cavity when the protective cap member 912 does not retain the straw 1000 to the collar member 910.

Figure 12:
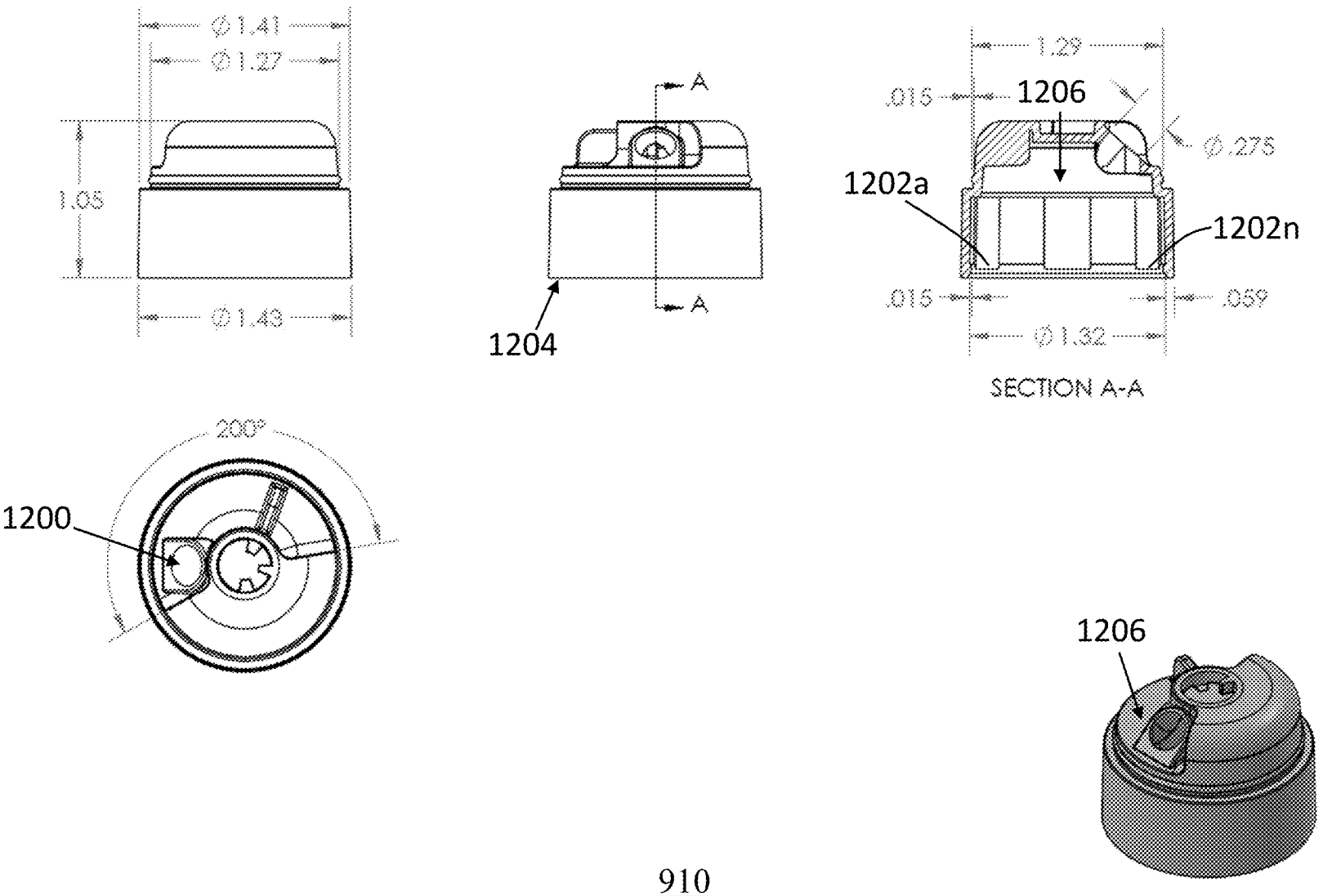
FIG. 12 depicts various views of a collar member in accordance with one embodiment of the present invention.
Figure 13:
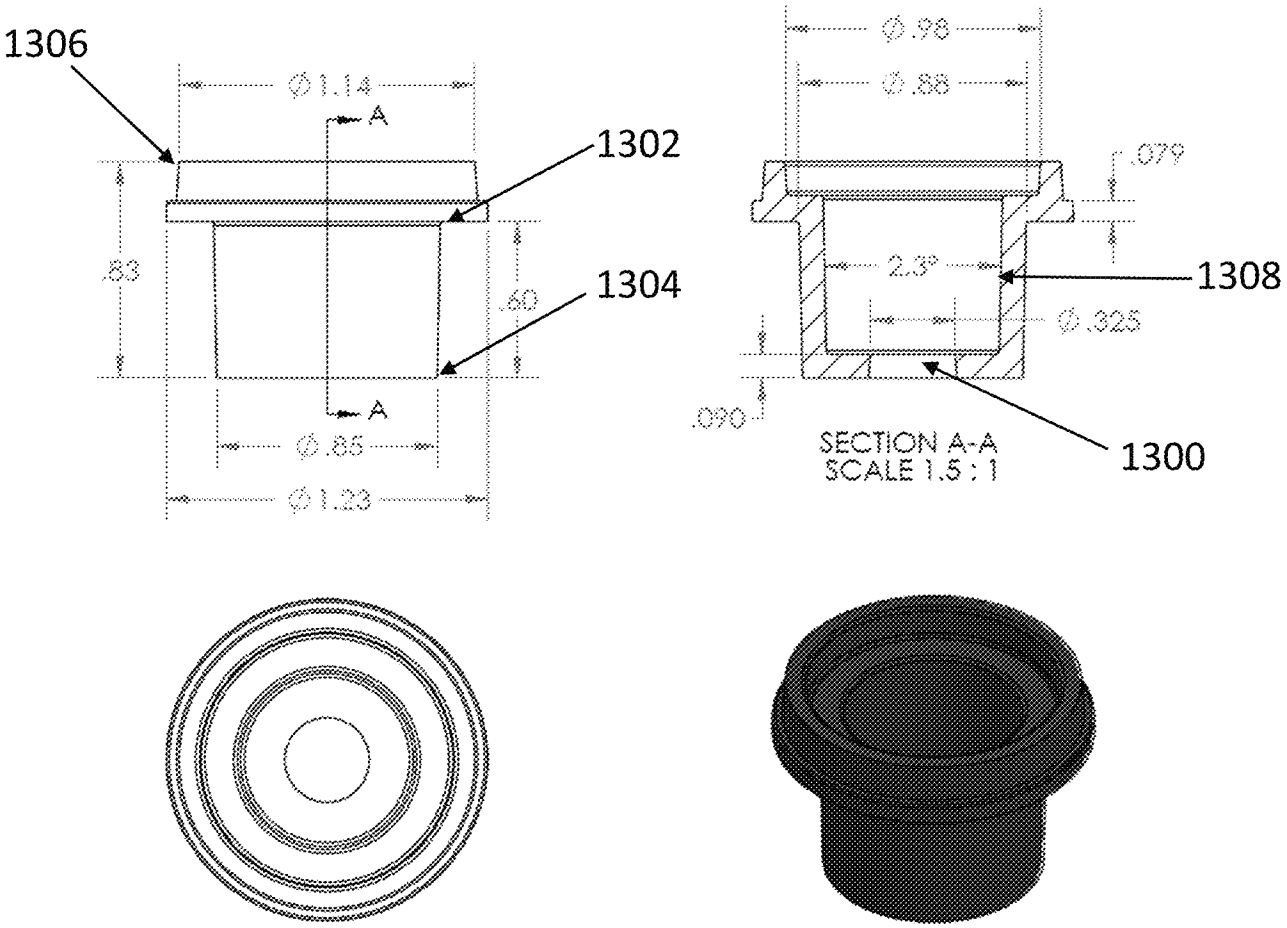
FIG. 13 depicts various views of a stopper member in accordance with one embodiment of the present invention.

The inner cap member 908 includes a sidewall 1004 with an inner surface having a thread configuration operably configured to selectively couple with a threaded configuration disposed on an outer surface of the sidewall of the storage container body or liquid container defining the respective enclosed upper apertures. In a preferred embodiment, the inner cap member 908 is substantially rigid and of a polymeric material, e.g., PVC, that does not deform when screwed onto the storage container body or liquid container. As seen in FIG. 12, the collar member 910 may include a lower end, an upper end, and a sidewall selectively removably coupled to the inner cap member 908, wherein the collar member defines a straw aperture 1200 on the upper end of the collar member 910 and with the straw 1000 protruding therethrough.

In a preferred embodiment, the collar member 910 may include a lower flange member 1008 spanning a circumference (continually or discontinuously) and that is operably configured to engage with an aperture/channel 1402 defined on the inner cap member 908 and/or prevented from moving longitudinally by a flange member 1010 disposed proximal (i.e., at or near, within approximately 15% of the longitudinal length) to the lower end 1404 of the inner cap member 908.

The protective cap member 912 may also include an upper wall and a sidewall, wherein the sidewall of the protective cap member 912 surrounds the upper wall of the protective cap member 912, defines a straw aperture thereon 914, and rotatably coupled to the collar member 910. The protective cap member 912 is operably configured to rotate with respect to the upper end of the collar member 910 to house and cover (in preferred embodiments, completely) the straw 1000 with the upper wall of the protective cap member 912. As depicted in the figures and described above, the user may rotatably couple the collar member 908 to the threaded configuration on the storage container body or liquid container body, such that the stopper member 906 is inserted through the upper aperture defined on the storage container body or liquid container body and circumferentially engages with the inner surface thereon. The sidewall of the stopper member 906 may deform and/or otherwise create that watertight configuration when the inner cap member 908 is fastened to the container body. The stopper member 906 may include an inner wall configuration 1012 configured to retain a portion of the straw 1000 in a desired orientation and straw configuration (as described below).

In one embodiment, the stopper member 906 and inner cap member 908 are coupled to the liquid container 702 without the collar member 910, thereby enabling insertion and removal of the straw and enabling flow of liquid housed in the container from the container cavity. The user may then insert a straw 1000 and slide the collar member 910 over the stopper member 906 until it engages, flexes, and locks with the inner cap member 908 (as best seen in FIG. 10). In other embodiments, the collar member 910 may slidably engage and couple with the inner cap member 908. The protective cap member 912 may be rotatably coupled to the collar member 910 and retain the straw 1000 as discussed above. An exploded view of the components and how they are assembled is depicted best in FIGS. 9-10.

As best depicted in FIG. 16, the straw 1000 may include a plurality of straw flanges 1600 disposed along its length, preferably closer to the upper distal end 1602. The plurality of straw flanges 1600 enables the straw 1000 to be placed in various straw configurations with respect to the stopper 906, namely the inner wall configuration 1012 disposed thereon. The plurality of straw flanges 1600 may include a first straw flange 1604 that defines at least one discontinuous radial channel or slit thereon (of a length of approximately 0.02-0.1 inches) permitting the flow of air through the straw channel 1300 when the straw is utilized by the user. This may be particularly advantageous for carbonated liquids housed in the liquid container 702. More specifically, the straw 1000 a perimeter portion or all of the inner wall configuration 1012 may be interposed between and/or retainer within the first straw flange 1604 and a second straw flange 1606. In another straw configuration, the perimeter portion or all of the inner wall configuration 1012 may be interposed between and/or retainer within the second straw flange 1606 and a third straw flange 1608, whereby the second and third straw flanges 1606, 1608 do not include any channels or slits, thereby creating an air-tight fit or configuration between the straw 1000 and the stopper 906.

The container cover assembly, as best seen depicted in FIGS. 9-16, can be seen having a stopper member 906 with an outer sidewall 1002, a lower end 1304 defining a straw channel 1300 that may be enclosed. The straw channel 1300 may be defined by the flexible straw member 1000 or may be defined by the stopper member 906. Preferably, as discussed above, the stopper member 906 may include an internal wall configuration 1012 for retaining the flexible straw member 1000, preferably the wall of the flexible straw member 1000 and/or the plurality of straw flanges 1602, 1604 disposed thereon. The stopper member 906 includes an upper end 1306 opposing a lower end 1304, and a flange member 1006 extending radially outward from the outer sidewall 1002 of the stopper member 906. In one embodiment, the outer sidewall 1002 is only of an elastically deformable material (as discussed above) to form a watertight fit with the inner surface of a container, e.g., container 920, where the enclosed upper aperture 922 is defined. In other embodiments, the entire stopper member 906 is of the elastically deformable material.

The outer sidewall 1002 of the stopper member 906 may taper in diameter toward the lower end 1304 of the stopper member 906 (as best seen in FIG. 10). Additionally, internal wall configuration 1012 may also taper (upwardly) and longitudinally to enable fluid communication between a cavity 1020 defined by the stopper member 906 (as discussed herein) and the ambient environment 1024 surrounding the stopper member 906.

The assembly also includes an inner cap member 908 with an upper surface 1400 having the flange member 1006 of the stopper member 906 seated thereon. The inner cap member 908 includes a lower surface 1410 opposing the upper surface 1400 of the inner cap member 908 and a sidewall 1004 with an inner surface 1406 having a threaded configuration 1408. The inner cap member 908 is operably configured to be selectively and removably couple with a complementary threaded configuration 916 disposed on an outer surface of the sidewall 918 of the liquid container 920 defining an enclosed upper aperture 922 thereon. In one embodiment, the inner cap member 908 and the threaded configuration 1408 are of a substantially rigid material, e.g., polypropylene, whereby the inner cap member 908 and the threaded configuration 1408 is rotatably coupled to the container 920. The inner surface 1406 of the sidewall 1004 and the outer sidewall 1002 define a double-walled enclosed container channel 1022 shaped and sized to receive the sidewall 918 of the liquid container 920. In preferred embodiments, the rigidity of the inner cap member 908 causes the stopper member 906 to compress against the container 920 when screwed onto the container 920. The inner cap member 908 also includes an upper wall 1024 (that is preferably annular) that is seated onto the surface of the container 920 that defines the aperture 922.

In one embodiment, the inner cap member 908 has a flange member 1010 extending radially outward from the sidewall 1004 of the inner cap member 908 and that is disposed proximal (at or near—withing approximately 10-15% of the longitudinal length) to a lower end 1404 of the inner cap member 908 that includes the lower surface 1410 of the inner cap member 908. The inner cap member 908 may also include the collar member 910 seated thereon. The inner cap member 908 and the collar member 910 may be coupled together using a snap-fit configuration or tongue-and-groove configuration.

The assembly also includes a collar member 910 with a lower end 1204, an upper end 1206 opposing the lower end 1204, a sidewall 1014, and defines an enclosed straw aperture 1200 on the upper end 1206 of the collar member 910, wherein the collar member 910 selectively removably coupled in a longitudinally locked configuration with the inner cap member 908. Said another way, when the collar member 910 is coupled with the inner cap member 908 it is prevented from longitudinal movement upon normal longitudinally applied (or upward) forces, e.g., 1-2 lbf. Said differently, when the collar member 910 is coupled with the inner cap member 908 it does not freely move in the longitudinal (or upward) direction.

In one embodiment, the inner cap member 908 has a plurality of retention apertures 1402 individually defined circumferentially around the sidewall 1004 of the inner cap member 908 and configured to receive one of a plurality locking 1202*a-n* disposed individually and circumferentially around the inner surface 1208 of the collar member 910. The plurality locking 1202*a-n* (wherein "n" is any number greater than one) may be disposed proximal (at or near) to a lower end 1404 of the inner cap member 908 when coupled together. The collar member 910 is also preferably rotationally locked with respect to the inner cap member 908, such that rotation of the protective cap member 912 does not rotate the collar member 910.

The inner cap member 908 includes the lower surface 1410 of the inner cap member 908, and includes the collar member 910 seated thereon. The beneficial wall configuration between the inner cap member 908 and the collar member 910 can also be seen to sandwich or flank the upper flange of the stopper member 906. In further embodiments, the lower surface 1410 of the inner cap member 908 is interposed between the lower end 1304 of the stopper member 906 and the upper surface 1400 of the inner cap member 908 to enable effective coupling of the stopper member 906 with the container 920.

The assembly also beneficially includes a protective cap member 912 with an upper wall 1100 and a sidewall 1102. The sidewall 1102 of the protective cap member 912 surrounds the upper wall 1100 of the protective cap member 912, defining a straw cap aperture 1104 thereon, and is rotatably coupled to the collar member 910. The protective cap member 912 is selectively rotatably coupled in a longitudinally locked configuration (as discussed above) to the collar member 910.

The assembly may also beneficially include a flexible straw member 1000 with a lower end 1610, an upper distal end 1602 opposing the lower end 1610 of the flexible straw member 1000, and a straw conduit 1614 separating the lower end 1610 of the flexible straw member 1000 and the upper distal end 1602 of the flexible straw member 1000, wherein the straw member 1000 is operably configured to project through the straw cap aperture 1104 and have the upper distal end 1602 disposed above the upper wall 1100 of the protective cap member 912. In one embodiment, the protective cap member 912 operably configured to rotate with respect to the upper end 1206 of the collar member 910 to house and cover the flexible straw member 1000 with the upper wall 1100 of the protective cap member 912.

In one embodiment, the flexible straw member 1000 is disposed through the enclosed straw channel 1300 of the stopper member 906 and the enclosed straw aperture 1200 of the collar member 910. In another embodiment, the stopper member 906 forms the straw conduit 1614 and is adapted to engage or couple with another straw member configured to be inserted within the container 920.

Beneficially, as best shown in FIG. 16, the flexible straw member 1000 defines a straw length separating the lower and upper distal ends 1610, 1602 of the flexible straw member 1000, wherein the flexible straw member 1000 includes a plurality of straw flanges 1602, 1604, 1608, 1612 extending radially outward from the flexible straw member 1000 along the straw length and with one of the first plurality flanges defining a slit 1614 thereon. As can be gleaned from FIG. 10 and FIG. 16, the first plurality of straw flanges has a first straw coupling configuration with the outer sidewall 1002 that fluidly couples an ambient environment 1024 around the stopper member 906 with an enclosed cavity 1020 defined by an inner surface 1308 of the outer sidewall 1002 of the stopper member 906. The flexible straw member 1000 also includes a second straw coupling configuration with the outer sidewall 1002 in a watertight configuration with the flexible straw member 1000. The plurality of straw flanges 1602, 1604, 1608, 1612.

The assembly also beneficially includes a storage container body 902 with a bottom wall 1500 and a sidewall 1502 enclosing the bottom wall 1500 and defining a storage cavity 1504 and an enclosed upper aperture 1506, wherein the threaded configuration 1408 of the inner cap member 908 is operably configured to selectively and removably couple with a complementary threaded configuration 1508 disposed on the storage container body 902 and house the flexible straw member 1000 and the stopper member 906.

What is claimed is:

1. A container cover assembly comprising:

a stopper member having an outer sidewall, a lower end defining an enclosed straw channel, an upper end opposing a lower end, a flange member extending radially outward from the outer sidewall of the stopper member, the outer sidewall of an elastically deformable material;

an inner cap member with an upper surface having the flange member of the stopper member seated thereon, a lower surface opposing the upper surface of the inner cap member, and a sidewall with an inner surface having a threaded configuration operably configured to selectively and removably couple with a complementary threaded configuration disposed on an outer surface of the sidewall of the liquid container defining an enclosed upper aperture thereon, the inner surface of the sidewall and the outer sidewall defining a double-walled enclosed container channel shaped and sized to receive the sidewall of the liquid container;

a collar member with a lower end, an upper end opposing the lower end, a sidewall, and defining an enclosed straw aperture on the upper end of the collar member, the collar member selectively removably coupled in a longitudinally locked configuration with the inner cap member;

a protective cap member with an upper wall and a sidewall, the sidewall of the protective cap member surrounding the upper wall of the protective cap member, defining a straw cap aperture thereon, and rotatably coupled to the collar member; and a flexible straw member with a lower end, an upper distal end opposing the lower end of the flexible straw member, a straw conduit separating the lower end of the flexible straw member and the upper distal end of the flexible straw member, and operably configured to project through the straw cap aperture and have the upper distal end disposed above the upper wall of the protective cap member, the protective cap member operably configured to rotate with respect to the upper end of the collar member to house and cover the flexible straw member with the upper wall of the protective cap member.

2. The container cover assembly according to claim 1, wherein:

the outer sidewall of the stopper member tapers in diameter toward the lower end of the stopper member.

3. The container cover assembly according to claim 1, wherein the inner cap member further comprises:

a flange member extending radially outward from the sidewall of the inner cap member, disposed proximal to a lower end of the inner cap member that includes the lower surface of the inner cap member, and having the collar member seated thereon.

4. The container cover assembly according to claim 1, wherein the inner cap member further comprises:

a plurality of retention apertures individually defined circumferentially around the sidewall of the inner cap member and configured to receive one of a plurality locking disposed individually and circumferentially around the sidewall of the collar member, the plurality of retention apertures disposed proximal to a lower end of the inner cap member that includes the lower surface of the inner cap member, wherein the collar member is seated on the inner cap member.

5. The container cover assembly according to claim 1, wherein:

the protective cap member is selectively rotatably coupled in a longitudinally locked configuration to the collar member.

6. The container cover assembly according to claim 1, wherein:

the lower surface of the inner cap member is interposed between the lower end of the stopper member and the upper surface of the inner cap member.

7. The container cover assembly according to claim 1, wherein:

the flexible straw member is disposed through the enclosed straw channel of the stopper member and the enclosed straw aperture of the collar member.

8. The container cover assembly according to claim 1, further comprising:

a storage container body with a bottom wall and a sidewall enclosing the bottom wall and defining a storage cavity and an enclosed upper aperture, the threaded configuration of the inner cap member operably configured to selectively and removably couple with a complementary threaded configuration disposed on the storage container body and house the flexible straw member and the stopper member.

9. The container cover assembly according to claim 1, wherein the flexible straw member further comprises:

a straw length separating the lower and upper distal ends of the flexible straw member, the flexible straw member including a plurality of straw flanges extending radially outward from the flexible straw member along the straw length and with one of the first plurality of straw flanges defining a slit thereon, wherein the first plurality flanges having a first straw coupling configuration with the outer sidewall and fluidly coupling an ambient environment around the stopper member with an enclosed cavity defined an inner surface of the outer sidewall of the stopper member.

10. The container cover assembly according to claim 9, wherein the flexible straw member further comprises:

a second straw coupling configuration with the outer sidewall in a watertight configuration with the flexible straw member.

11. A container cover assembly comprising:

a stopper member having an outer sidewall, a lower end defining an enclosed straw channel, an upper end opposing a lower end, a flange member extending radially outward from the outer sidewall of the stopper member, the outer sidewall of an elastically deformable material;

an inner cap member with an upper surface having the flange member of the stopper member seated thereon, a lower surface opposing the upper surface of the inner cap member, and a sidewall with an inner surface having a threaded configuration operably configured to selectively and removably couple with a complementary threaded configuration disposed on an outer surface of the sidewall of the liquid container defining an enclosed upper aperture thereon, the inner surface of the sidewall and the outer sidewall defining a double-walled enclosed container channel shaped and sized to receive the sidewall of the liquid container;

a collar member with a lower end, an upper end opposing the lower end, a sidewall, and defining an enclosed straw aperture on the upper end of the collar member, the collar member selectively removably coupled in a longitudinally locked configuration with the inner cap member;

a protective cap member with an upper wall and a sidewall, the sidewall of the protective cap member surrounding the upper wall of the protective cap member, defining an enclosed straw cap aperture thereon, and rotatably coupled to the collar member;

a flexible straw member with a lower end, an upper distal end opposing the lower end of the flexible straw member, a straw conduit separating the lower end of the flexible straw member and the upper distal end of the flexible straw member, and operably configured to project through the straw cap aperture and have the upper distal end disposed above the upper wall of the protective cap member, the protective cap member operably configured to rotate with respect to the upper end of the collar member to house and cover the flexible straw member with the upper wall of the protective cap member; and a storage container body with a bottom wall and a sidewall enclosing the bottom wall and defining a storage cavity and an enclosed upper aperture, the threaded configuration of the inner cap member operably configured to selectively and removably couple with a complementary threaded configuration disposed on the storage container body and house the flexible straw member and the stopper member.

12. The container cover assembly according to claim 11, wherein:

the outer sidewall tapers in diameter toward the lower end of the stopper member.

13. The container cover assembly according to claim 11, wherein the inner cap member further comprises:

a flange member extending radially outward from the sidewall of the inner cap member, disposed proximal to a lower end of the inner cap member that includes the lower surface of the inner cap member, and having the collar member seated thereon.

14. The container cover assembly according to claim 11, wherein the inner cap member further comprises:

a plurality of retention apertures individually defined circumferentially around the sidewall of the inner cap member and configured to receive one of a plurality locking disposed individually and circumferentially around the sidewall of the collar member, the plurality of retention apertures disposed proximal to a lower end of the inner cap member that includes the lower surface of the inner cap member, wherein the collar member is seated on the inner cap member.

15. The container cover assembly according to claim 11, wherein:

the protective cap member is selectively rotatably coupled in a longitudinally locked configuration to the collar member.

16. The container cover assembly according to claim 11, wherein:

the lower surface of the inner cap member is interposed between the lower end of the stopper member and the upper surface of the inner cap member.

17. The container cover assembly according to claim 11, wherein:

the flexible straw member is disposed through the enclosed straw channel of the stopper member and the enclosed straw aperture of the collar member.

* * * * *